US006419224B1

(12) United States Patent
Tsai

(10) Patent No.: US 6,419,224 B1
(45) Date of Patent: Jul. 16, 2002

(54) COMPLEX MULTIFUNCTIONAL GAME TABLE STRUCTURE

(76) Inventor: Lore Tsai, No. 221, Lane 20, Zichiang Street, Taichung (TW)

( * ) Notice: Subject to any disclaimer, the term of this patent is extended or adjusted under 35 U.S.C. 154(b) by 0 days.

(21) Appl. No.: 09/820,908

(22) Filed: Mar. 30, 2001

(51) Int. Cl.[7] ..... A63F 7/06; A63D 15/04

(52) U.S. Cl. ..... 273/108.1; 273/126 A; 273/309; 473/10; 473/14

(58) Field of Search ..... 273/108.1, 309, 273/284, 287; 108/50.4, 153.1, 159; 473/4, 6, 10, 14

(56) References Cited

U.S. PATENT DOCUMENTS

| | | | | |
|---|---|---|---|---|
| 4,063,728 A | * | 12/1977 | Zemanek | 273/108.1 |
| 4,927,140 A | * | 5/1990 | Pappas | 473/11 |
| 5,752,886 A | * | 5/1998 | Tien | 273/108.1 |
| 6,109,607 A | * | 8/2000 | Cartwright et al. | 273/108.1 |
| 6,349,939 B1 | * | 2/2002 | Tsai | 273/108.1 |

* cited by examiner

*Primary Examiner*—Raleigh W. Chiu
(74) *Attorney, Agent, or Firm*—Troxell Law Office PLLC

(57) ABSTRACT

Complex multifunctional game table structure including: a table body; a base board fixedly disposed in a table frame of the table body to define a receiving space open to upper side; two ball-collecting boxes fixed at two ends of bottom face of the base board, a top face of the ball-collecting box communicating with a notch of short side of the base board, an upright face thereof communicating with a ball-taking opening of short side of the table frame; a fan fixed under the base board for blowing air upward; a hockey game board body having a frame body and a partitioning board disposed therein, a top face of the partitioning board defining a recessed game space, a bottom face thereof defining a recessed air room, a number of fine vents being densely arranged over the partitioning board; two ball entrances formed on inner walls of short sides of the frame body communicating with the game space; and a billiard board body. Four corners and the middles of two long sides thereof are respectively formed with six arched recesses. The game table is convertible for playing different games. When playing hockey, the hockey has better slidability to enhance the fun in playing the game.

6 Claims, 11 Drawing Sheets

COMPLEX MULTIFUNCTIONAL GAME TABLE STRUCTURE

BACKGROUND OF THE INVENTION

The present invention is related to a game table structure which is convertible between a billiard table and a hockey game table. The game table has simple structure. When playing hockey, the hockey has better slidability to enhance the fun in playing the game.

FIG. 1 shows a conventional hockey game table which only provides hockey game for players. Recently, various kinds of convertible game tables have been developed. The configurations of these game tables as shown in FIGS. 5 and 6 can be converted for playing different games to enhance entertaining function of game tables.

FIGS. 1 to 4 show an early hockey game table 10 created by the applicant. Such hockey game table 10 includes: a table body 12; a wind-guiding board 14 positioned in a table frame 13 of the table body 12, the top face thereof being formed with multiple parallel wind-guiding channels 16, the bottom face being formed with a transverse excavation 18 with a certain width, the excavation IS communicating with the wind-guiding channels 16; a face panel 20 having a number of vents 22 densely arranged over the face panel 20 at equal intervals, the face panel 20 being sealedly connected to the top face of the wind-guiding board 14, each row of vents 22 being corresponding to a wind-guiding channel 16; an air room 25, the top face thereof being depressed to form an air chamber 26, the bottom of the air chamber 26 being formed with a through hole 27, the air room 25 being disposed under the wind-guiding board 14 to seal the excavation 18; and a fan 28 fixed at the through hole 27. The fan blows air to flow through the air chamber 26 into the wind-guiding channels 16. The air is then blown out from the vents 22 to reduce the frictional force between the hockey 29 and the face panel 20 and enhance slidability of the hockey.

The above hockey game table 10 cannot be converted into other configuration for playing other games. Moreover, such hockey game table has complicated structure and is manufactured at high cost.

FIGS. 5 and 6 show a game table 30 which was also created by the applicant. Such game table 30 includes a table body 32 and a table board 35. The top and bottom faces of the table board 35 are designed with different configurations. The top face 36 is formed as a billiard table face, while the bottom face 38 is formed as a hockey game table face as shown in FIG. 6. When the table board 35 is placed into the table frame 33 with the top face 36 facing upward as shown in FIG. 5, in cooperation with the six pockets 34 of the table body, a billiard table is formed. Alternatively, when the bottom face 38 of the table board 35 faces upward, the game table is converted into a hockey game table.

Such game table 30 can be converted into a hockey game table. However, it is impossible to equip the game table with a blowing mechanism. Therefore, great frictional force exists between the hockey and the table board 35 and the playing effect is poor.

SUMMARY OF THE INVENTION

It is therefore a primary object of the present invention to provide a complex multifunctional game table which is convertible between a billiard table and a hockey game table. A blowing mechanism is disposed in the game table, whereby when playing hockey, the hockey has better slidability to enhance the fun in playing the game.

It is a further object of the present invention to provide the above complex multifunctional game table which has simple structure.

The present invention can be best understood through the following description and accompanying drawings wherein:

DETAILED DESCRIPTION OF THE PREFERRED EMBODIMENTS

Figure 1:
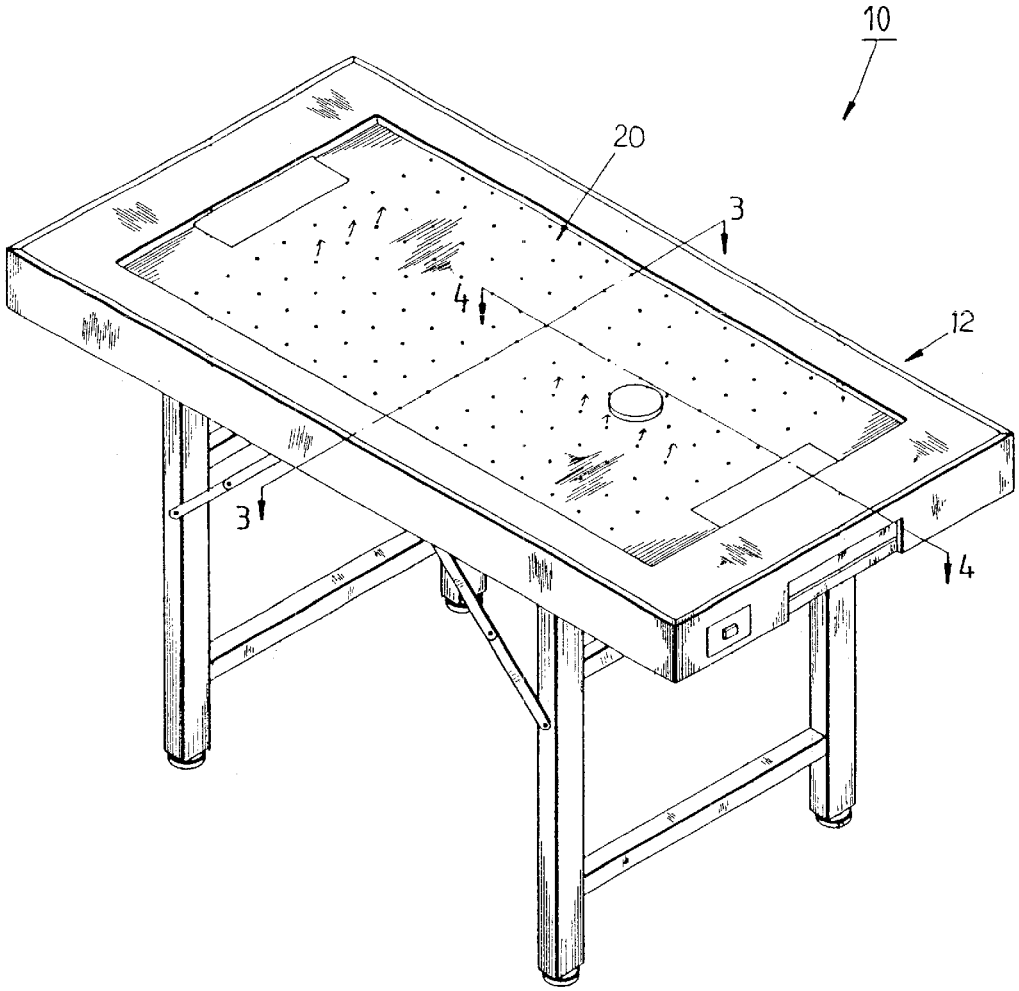
Fig.1 Prior Art
FIG. 1 is a perspective view of a conventional hockey game table.
Figure 3:
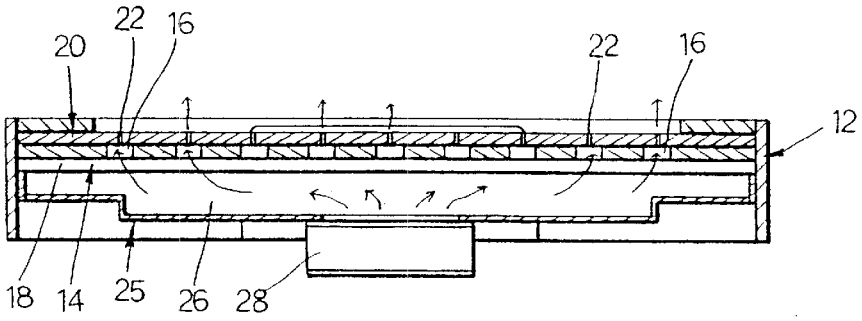
Fig.3 Prior Art
FIG. 3 is a sectional view taken along line 3—3 of FIG. 1, showing the blown air.
Figure 2:
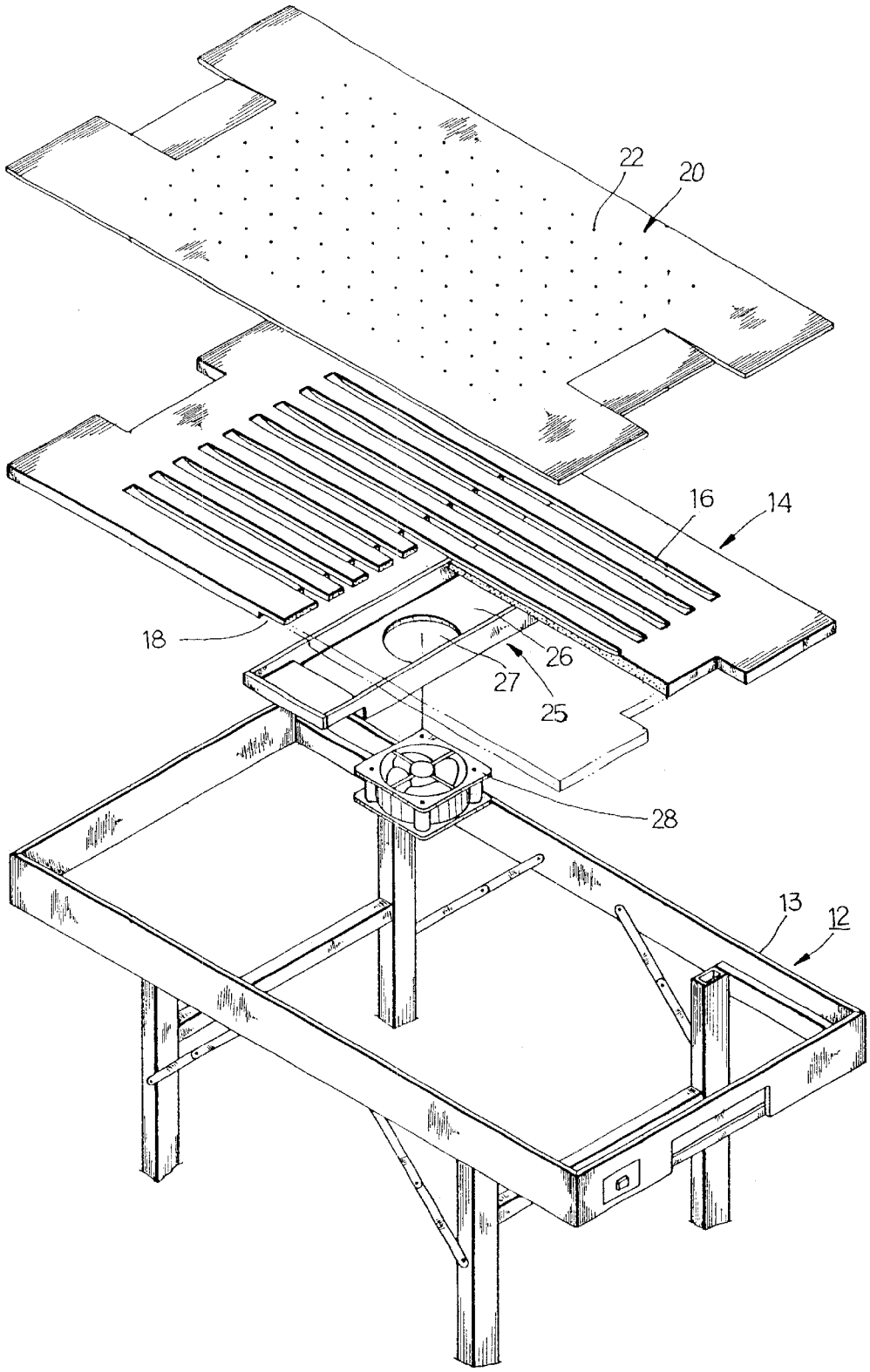
Fig.2 Prior Art
FIG. 2 is a perspective exploded view of the hockey game table of FIG. 1.
Figure 4:
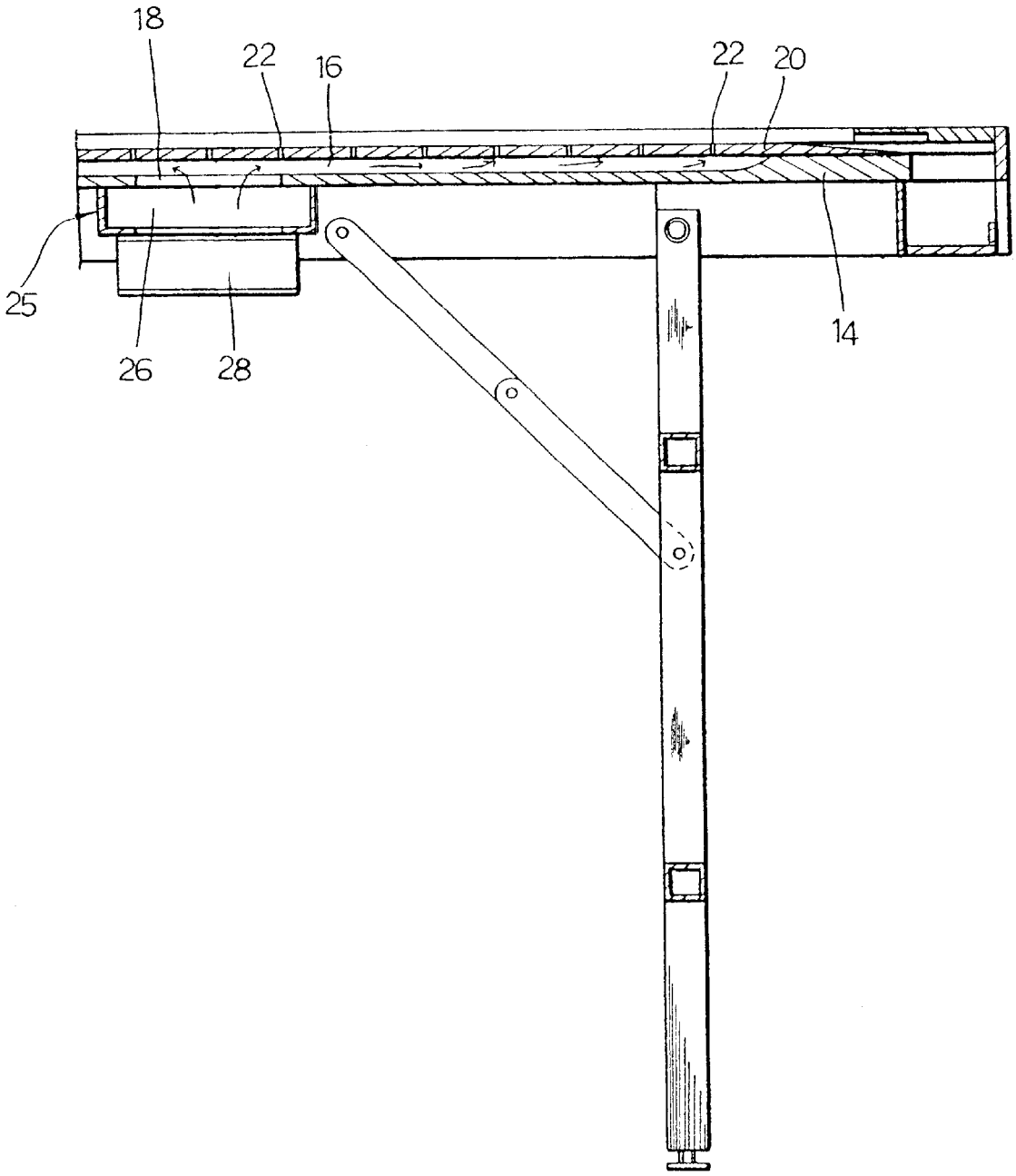
Fig.4 Prior Art
FIG. 4 is a sectional view taken along line 4—4 of FIG. 1, showing the blown air.
Figure 6:
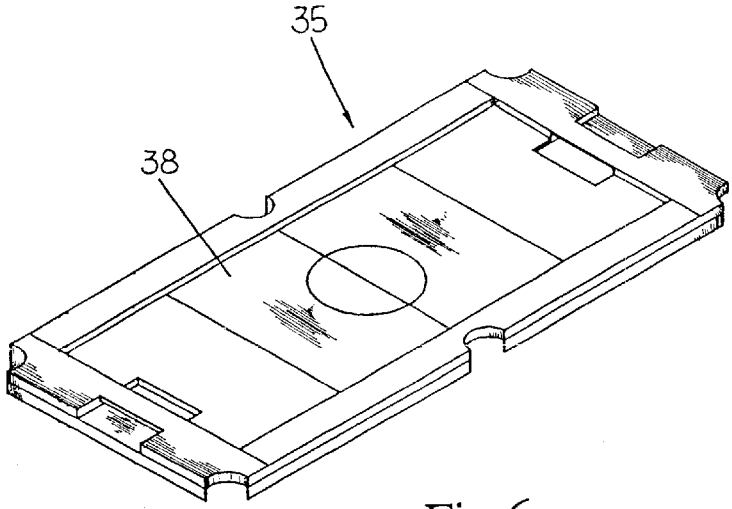
Fig.6 Prior Art
FIG. 6 is a perspective view of the table board of FIG. 5, in which the bottom face of the table board faces upward.
Figure 5:
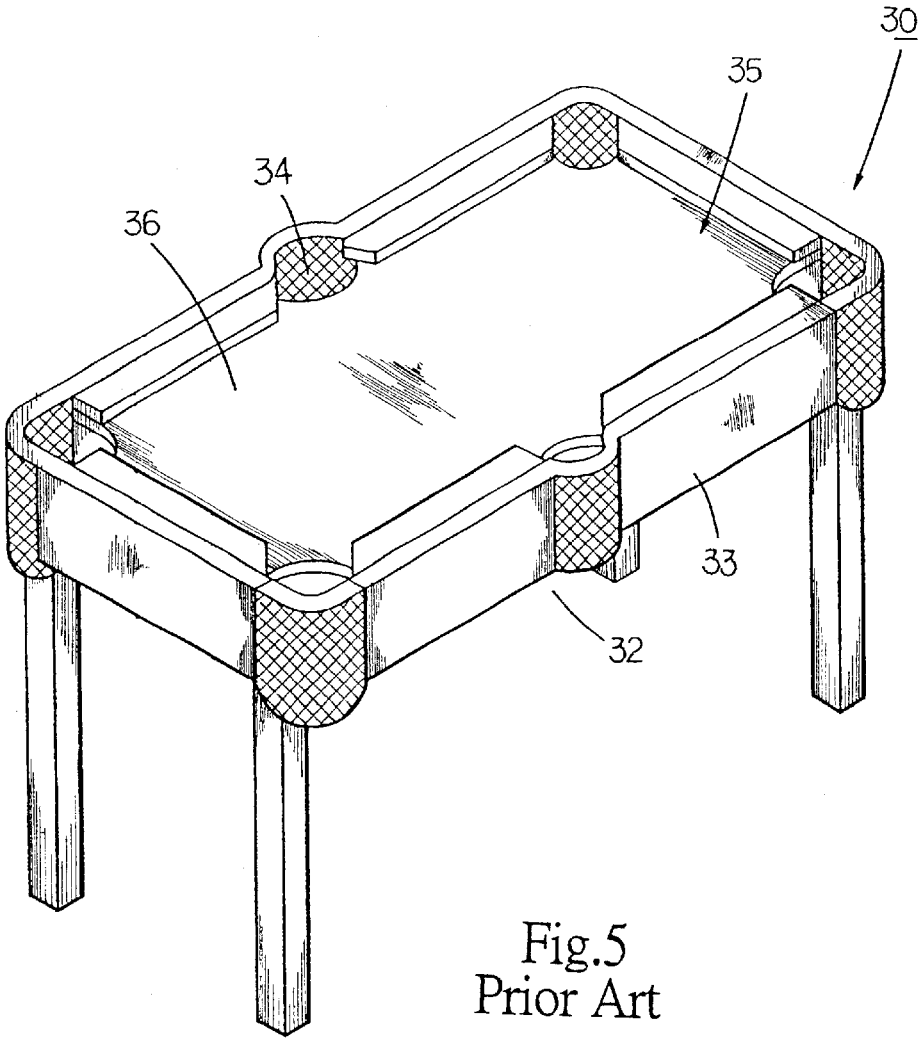
Fig.5 Prior Art
FIG. 5 is a perspective view of another type of conventional game table.
Figure 7:
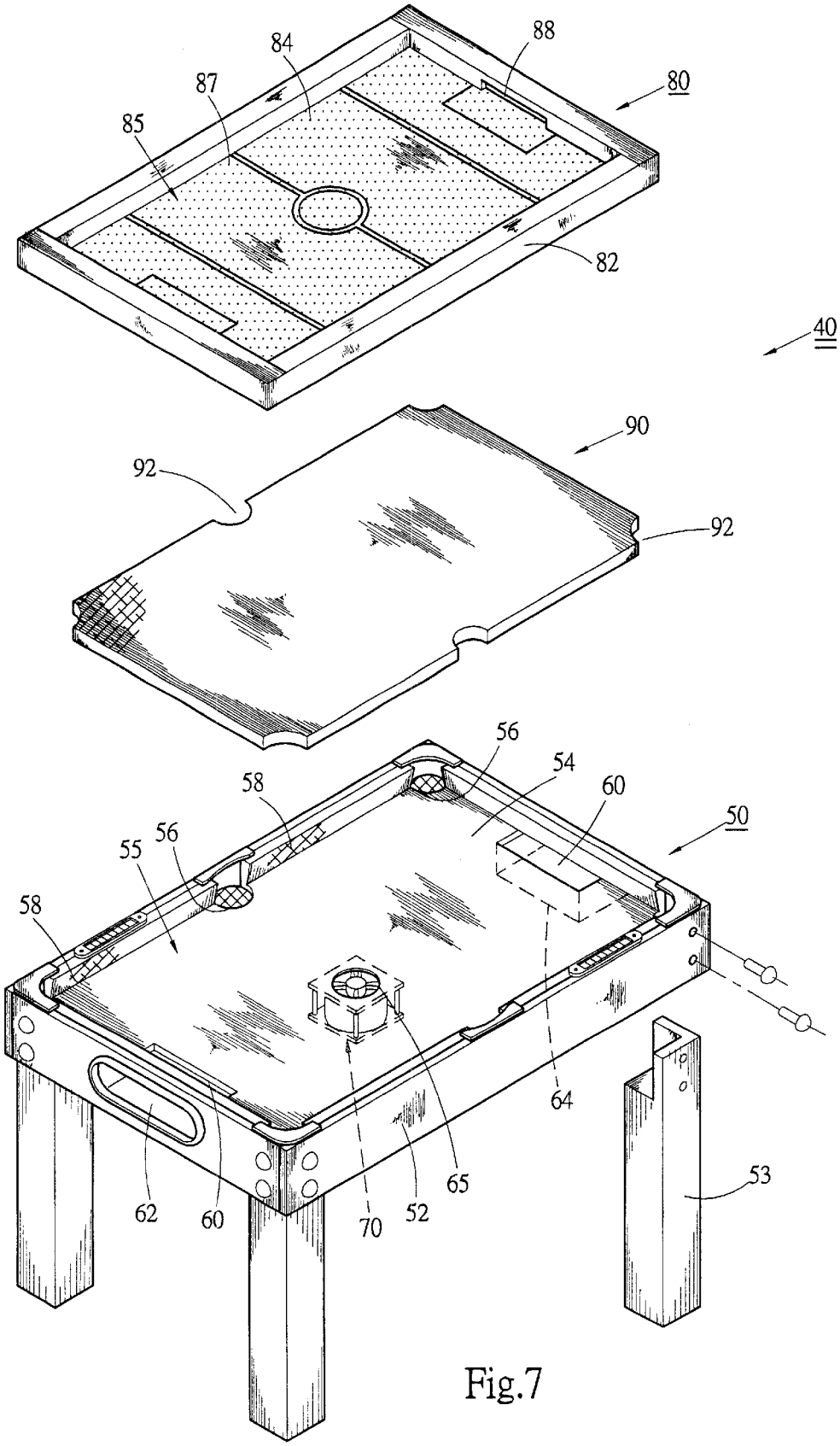
FIG. 7 is a perspective exploded view of a preferred embodiment of the present invention.
Figure 9:
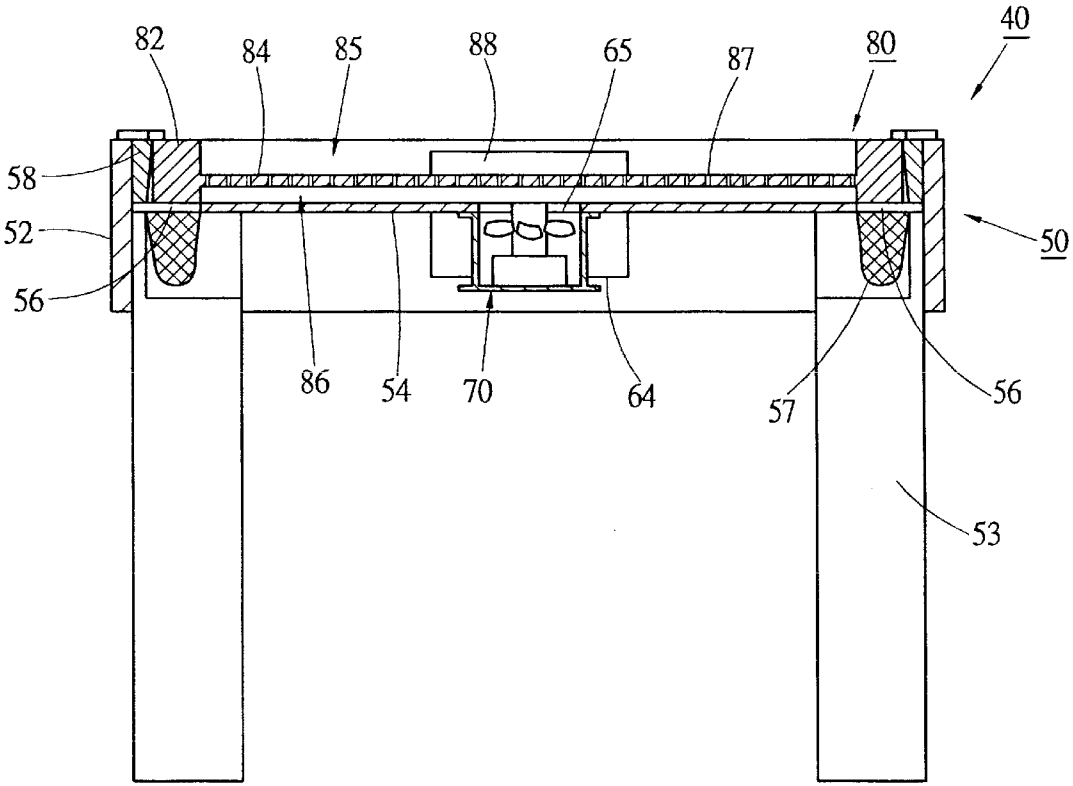
FIG. 9 is a sectional view taken along line 9—9 of FIG. 7.
Figure 10:
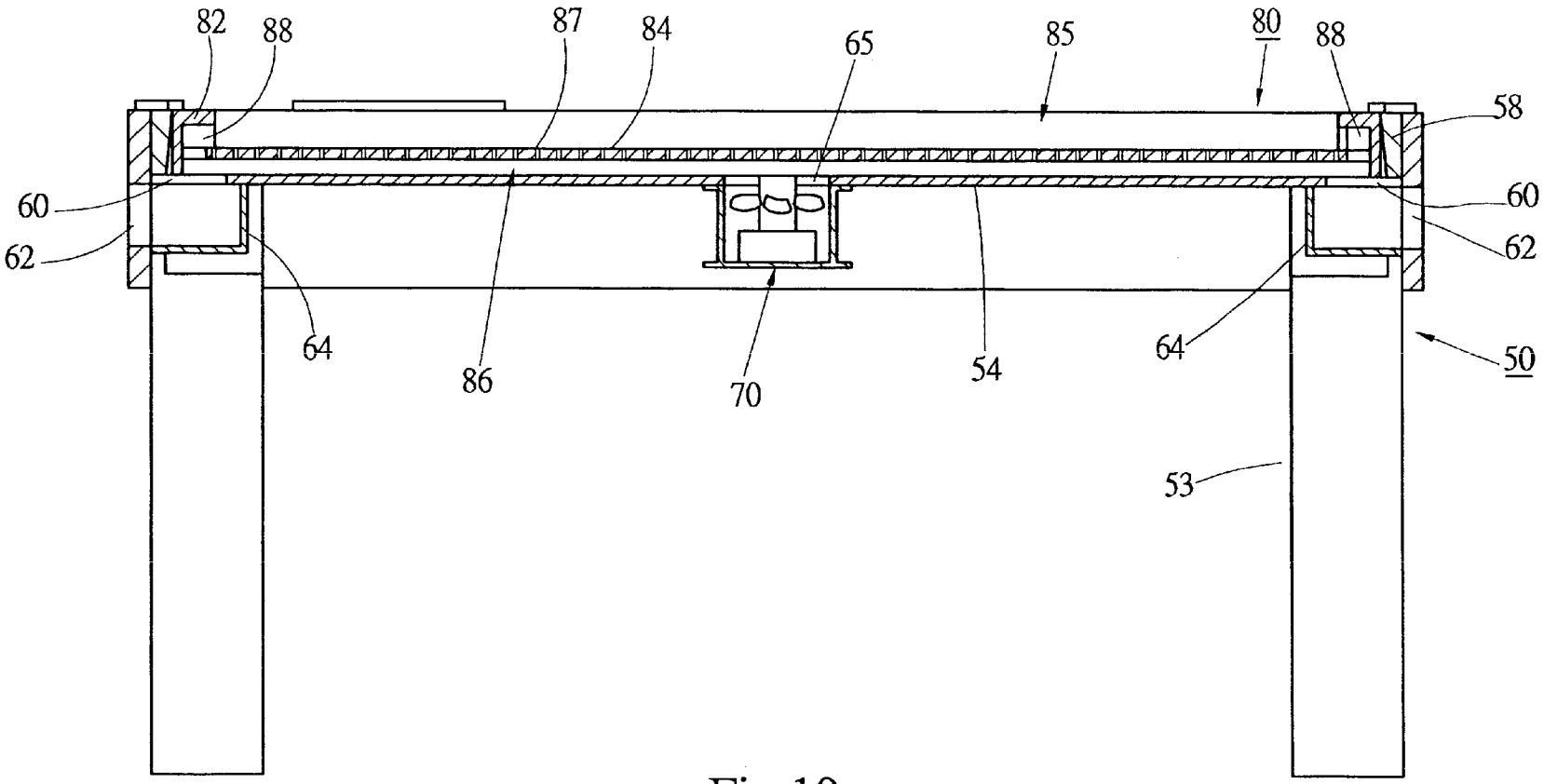
FIG. 10 is a sectional view taken along line 10—10 of FIG. 7.

Please refer to FIG. 7. According to a preferred embodiment, the game table 40 of the present invention includes:

a table body 50 including: a rectangular table frame 52 and four table legs 53 fixedly connected with four corners of the table frame 52; a base board 54 fixedly disposed in the table frame 52 below the top edge of the table frame 52, the base board and the table frame defining a receiving space 55 with an opening facing upward, four corners and middles of two long sides of the base board 54 being respectively formed with six arched recesses 56, a mesh-like ball pocket 57 being disposed under each recess 56 as shown in FIG. 9; six protective bars 58 made of soft material, a woven fabric layer being laid over the surface of the protective bar 58, the protective bars 58 being arranged along the inner wall of the table frame 52, two ends of each protective bar being adjacent to two adjacent recesses 56, in addition, two short sides of the base board 54 being respectively formed with two notches 60, two short sides of the table frame being respectively formed with two ball-taking openings 62; two ball-collecting boxes 64, a top side and an upright side of each ball-collecting box being open as shown by phantom line of FIG. 7 and FIGS. 9 and 10, the ball-collecting box 64 being fixed at two ends of bottom face of the base board 54 with the top opening communicating with the notch 60 of the base board and with the upright opening communicating with the ball-taking opening 62 of the table frame, the center of the base board 54 being formed with a through hole 65;

a fan 70 fixed under the base board 54 with vanes aimed at the through hole 65 for upward blowing air into the receiving space 55;

a hockey game board body 80 having a rectangular frame body 82 and a partitioning board 84 disposed in the frame body 82, the top face of the partitioning board 84 being marked with certain lines, the top face and the frame body 82 defining a recessed game space 85, the bottom face of the partitioning board and the frame body 82 defining a recessed air room 86 as shown in FIGS. 9 and 10, the face of the partitioning board 84 having a number of fine vents 87 densely arranged over the face and communicating with the air room 86 and the game space 85, inner walls of two sides of the frame body 82 being respectively formed with two ball entrances 88, outer end of the ball entrance 88 communicating with the game space 85, inner end thereof downward extending through the bottom face of the board body 80 to form an exit; and a billiard board body 90 which is a rectangular plane board, four corners and the middles of two long sides thereof being respectively formed with arched recesses 92, a woven fabric layer being laid over the surface of the board body 90.

In use, the hockey game board body 80 and the billiard board body 90 is replaceably mounted on the table body 50 for playing different games.

Figure 8:
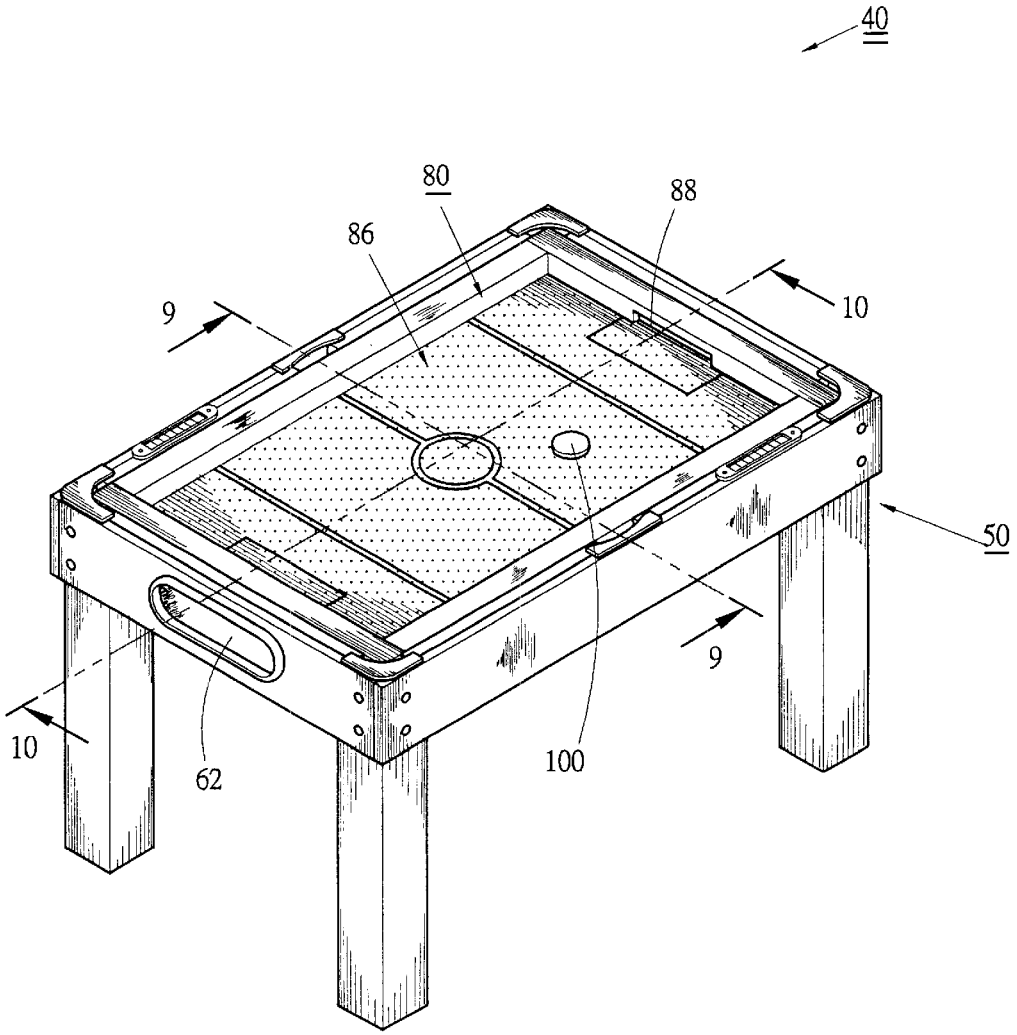
FIG. 8 is a perspective view showing that the game table of FIG. 7 is used as a hockey game table.

After the hockey game board body 80 is mounted in the receiving space 55 of the table body 50, as shown in FIGS. 8 to 10, the exits of inner ends of the two ball entrances 88 of the board body 80 respectively communicate with the two notches 60 of the base board 54 and the bottom edge of the frame body 82 of the board body 80 covers the recesses 56. Accordingly, players can play hockey game. In playing the game, the fan 70 is first powered on to blow air upward into the air room 86. The air filled in the air room is then blown out of the vents 87, whereby upward blown small air streams are distributed over the game space 85. When the players drive the hockey 100 within the game space 85, the frictional force between the hockey 100 and the partitioning board 84 is reduced so that the hockey can well slide.

The hockey 100 enters the ball entrance 88 of the board body 80 and drops down through the notch 60 of the base board 54 into the ball-collecting box 64. The players can extend their hands through the ball-taking openings 62 into the ball-collecting boxes 64 for taking out the hockey for further playing the game.

Figure 11:
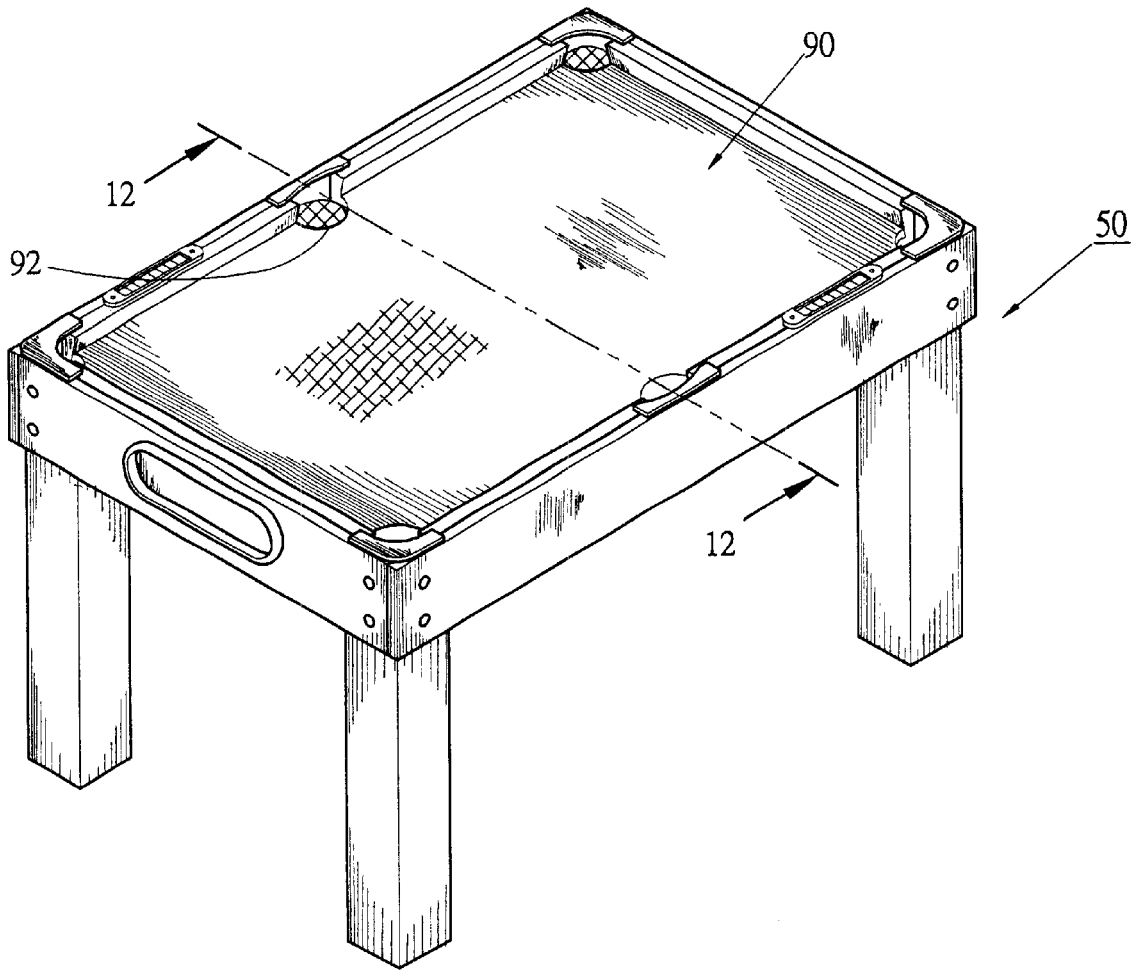
FIG. 11 is a perspective view showing that the game table of FIG. 7 is used as a billiard table.
Figure 12:
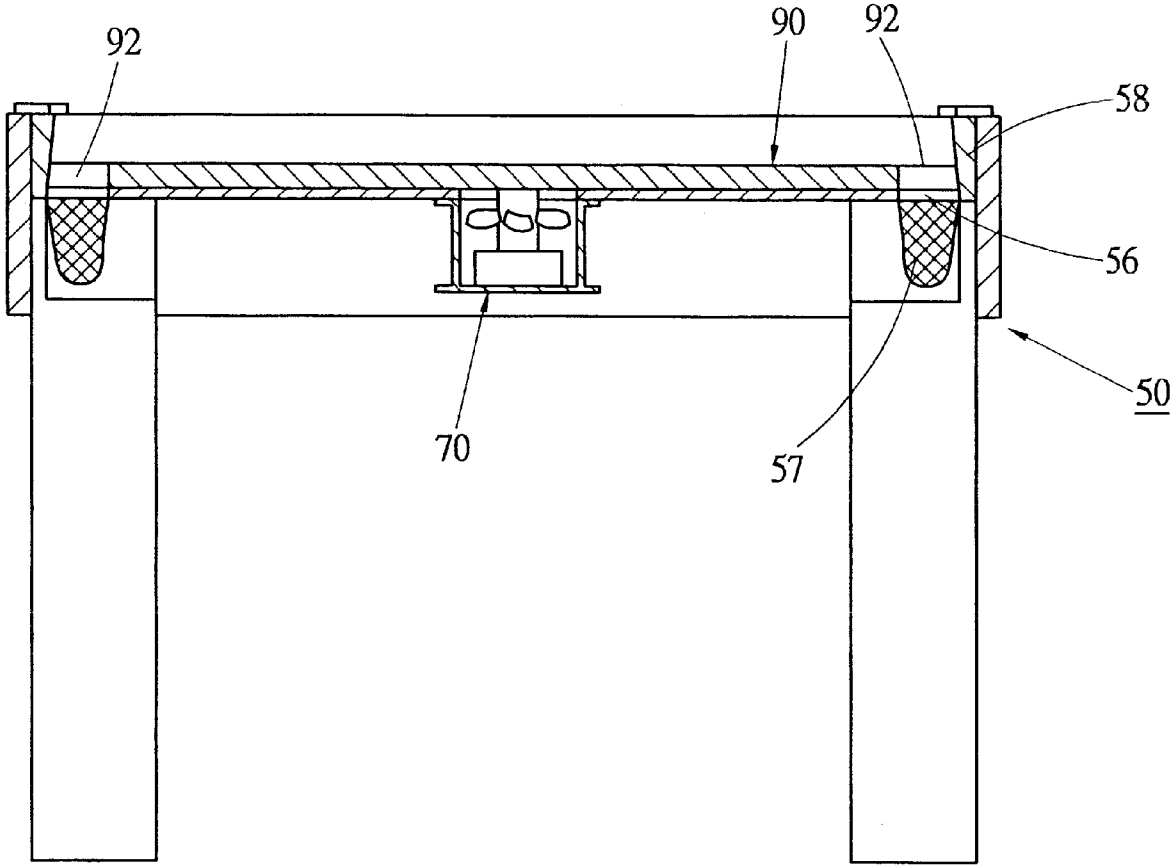
FIG. 12 is a sectional view taken along line 12—12 of FIG. 11.

When playing billiards, the hockey game board body 80 is taken off and the fan 70 is powered off. Then the billiard board body 90 is placed into the receiving space 55 as shown in FIG. 11 to form a plane billiard table face. The six arched recesses 92 of the board body 90 are aligned with the six recesses 56 of the base board 54 as shown in FIG. 12. The billiard balls can pass through the recesses 92 and 56 to drop into the pockets 57.

According to the above arrangement, the present invention has the following advantages:

1. The game table is convertible for playing different games. In addition, a blowing mechanism is disposed in the game table, whereby when playing hockey, the hockey has better slidability to enhance the fun in playing the game.
2. The blowing mechanism and the entire structure of the game table are simple and can be manufactured at low cost.

Figure 13:
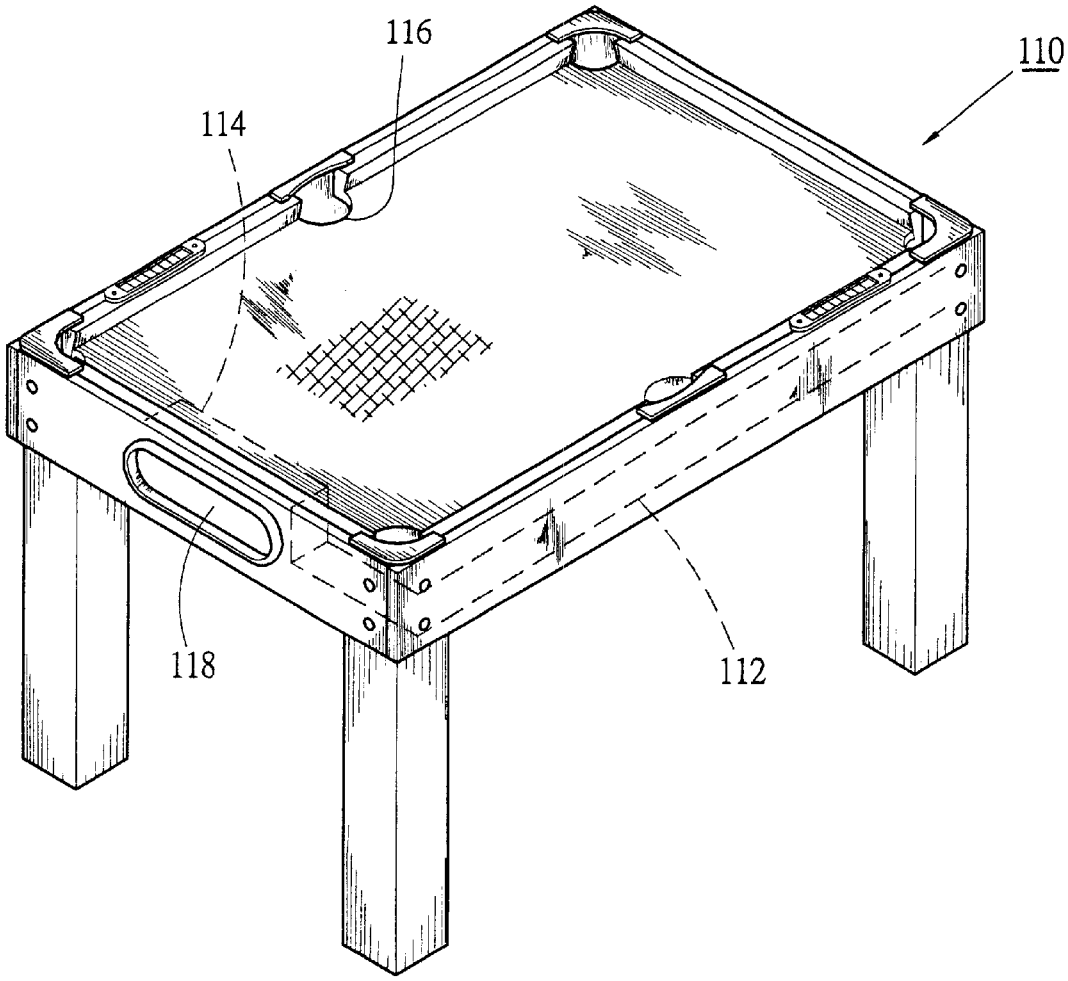
FIG. 13 is a perspective view of another embodiment of the present invention.

It should be noted that the pockets 57 of the table body 50 can be omitted. FIG. 13 shows another embodiment of the present invention, in which two inclined ball ways 112 can be disposed in the table body 110 along the long sides thereof. The ball ways 112 communicate with the ball-collecting box 114. When playing billiards, the balls dropping from the recesses 116 are guided by the ball ways 112 and roll to the ball-collecting box 114. The players can take out the balls from the ball-taking opening 118.

Furthermore, the protective bars 58 can be alternatively disposed along the periphery of the billiard board body 90 rather than the inner wall of the table frame as shown in FIG. 7.

The above embodiments are only used to illustrate the present invention, not intended to limit the scope thereof. Many modifications of the above embodiments can be made without departing from the spirit of the present invention.

What is claimed is:

1. Complex multifunctional game table structure comprising:

a table body including: a rectangular table frame and several table legs connected with the table frame; a base board fixedly disposed in the table frame below top edge thereof, the base board and the table frame defining a receiving space with an opening facing upward, four corners and middles of two long sides of the base board being respectively formed with six recesses, two short sides of the base board being respectively formed with two notches, two short sides of the table frame being respectively formed with two ball-taking openings; two ball-collecting boxes fixed at two ends of bottom face of the base board, a top face of the ball-collecting box communicating with the notch of the base board, an upright face communicating with the ball-taking opening, the center of the base board being former with a through hole;

a fan fixed under the base board at the through hole for blowing air upward;

a hockey game board body having a rectangular frame body and a partitioning board disposed in the frame body, a top face of the partitioning board and the frame body defining a recessed game space, a bottom face of the partitioning board and the frame body defining a recessed air room, the face of the partitioning board having a number of fine vents densely arranged over the face and communicating with the air room and the game space, inner walls of two short sides of the frame body being respectively formed with two ball entrances, outer end of the ball entrance communicating with the game space, inner end thereof downward extending through the bottom face of the board body; and a billiard board body which is a rectangular plane board, four corners and the middles of two long sides thereof being respectively formed with six arched recesses, a woven fabric layer being laid over the surface of the billiard board body, when the hockey game board body is placed in the receiving space of the table body, the inner ends of the two ball entrances respectively communicating with the two notches of the base board, the fan blowing air into the air room through the vents into the game space for playing hockey game, when the billiard board body is placed into the receiving space, the six recesses of the board body are aligned with the six recesses of the base board for playing billiards.

2. Complex multifunctional game table structure as claimed in claim 1, wherein the ball-collecting box is a hollow rectangular body, a top side and an upright side of the ball-collecting box being open to respectively communicate with the notch of the base board and the ball-taking opening of the table frame.

3. Complex multifunctional game table structure as claimed in claim 1, further comprising six protective bars, a woven fabric layer being laid over the surface of each protective bar, the protective bars being arranged in the receiving space along the inner wall of the table frame, two ends of each protective bar being adjacent to two adjacent recesses of the base board.

4. Complex multifunctional game table structure as claimed in claim 1, further comprising six protective bars, a woven fabric layer being laid over the surface of each protective bar, the protective bars being arranged along the periphery of top face of the billiard board body, two ends of each protective bar being adjacent to two adjacent recesses of the billiard board body.

5. Complex multifunctional game table structure as claimed in claim 1, wherein a ball pocket is disposed under each recess of the table body.

6. Complex multifunctional game table structure as claimed in claim 1, wherein two inclined ball ways are disposed in the table body along the long sides thereof under the recesses, the ball ways communicating with at least one ball-collecting box.

* * * * *